United States Patent [19]

Shepherd et al.

[11] Patent Number: 4,691,689

[45] Date of Patent: Sep. 8, 1987

[54] ONE PIECE ADJUSTABLE DAMPER

[75] Inventors: Charles G. Shepherd, Oakville; Samuel Travale, Stoney Creek, both of Canada

[73] Assignee: B. D. Wait Co. Limited, Oakville, Canada

[21] Appl. No.: 938,479

[22] Filed: Dec. 5, 1986

[30] Foreign Application Priority Data

Dec. 6, 1985 [CA] Canada ..... 497016

[51] Int. Cl.[4] ..... F23L 3/00

[52] U.S. Cl. ..... 126/295; 126/292; 126/285 R; 251/297; 98/41.1

[58] Field of Search ..... 126/295, 292, 285 R, 126/285 A, 289–291, 296, 297, 307 R, 312; 251/297; 98/41.1

[56] References Cited

U.S. PATENT DOCUMENTS

| | | | |
|---|---|---|---|
| 881,099 | 3/1908 | Fraser | 126/295 |
| 1,023,866 | 4/1912 | Mueller, Jr. | 126/295 |
| 1,125,416 | 1/1915 | Watson | 126/295 |
| 1,146,807 | 7/1915 | Massing | 126/292 |
| 1,325,237 | 12/1919 | Filbey | 126/292 |
| 1,604,219 | 10/1926 | Coventry | 126/292 |
| 3,007,673 | 11/1961 | Paxton et al. | 251/297 |
| 3,073,564 | 1/1963 | Alter | 126/295 |

*Primary Examiner*—James C. Yeung
*Attorney, Agent, or Firm*—Rogers & Scott

[57] ABSTRACT

This invention provides an adjustable damper having a tubular duct section defining first and second diametrically opposed openings and first and second sets of detents formed radially from the material of the duct about the respective openings to define a plurality of damper settings. The first detent set is offset angularly relative to the second detent set and a valve element is provided having a circular central portion proportioned to fit within the duct section. Diametrically opposed first and second shoulders project from the periphery of the disc and aligned first and second stub axles are formed from the material of the disc and depend from the respective first and second shoulders. These shoulders are engaged with the respective first and second sets of detents such that in any one selected angular position of the valve element, the element is located by engagement of one of the shoulders in one of the detents of the detent sets. Means is provided attached to one of the stub axles to permit manual operation to change the angular position of the element in the duct section for positioning one of the shoulders in another of the detents of the detent sets whereby the flow of air through the duct can be controlled in stages by moving the element between fully closed and fully open positions.

2 Claims, 4 Drawing Figures

ONE PIECE ADJUSTABLE DAMPER

This invention relates to humidifiers for forced air heating and in particular to an adjustable damper to control the flow of air through a humidifier associated with the heating system.

It has become common practice in forced air heating systems to use a humidifier to maintain an acceptable level of humidity in the building during cold weather. The level of humidity can be critical. If it is too low the inhabitants are bothered by static electricity and other effects are noticed such as the drying out of wood furniture which can cause the joints to loosen. On the other hand, if the humidity level is too high, moisture will condense on windows and other cold areas in the house resulting in damage to paintwork and wall coverings.

Present systems are controlled by a device commonly referred to as a "humidistat". This device usually senses the humidity of the air at a location in a living area of the house and, when the humidity falls below a preset level the humidistat will then cause the humidifier on the furnace to place moisture in a flow of hot air which is picked up and circulated throughout the house. However, because the humidistat is sensing moisture at one location only, it is necessary to add moisture at a controlled rate which does not cause local condensation on windows, etc. before the humidistat senses an increase in moisture and switches off the humidifier. It is therefore desirable that the amount of moisture picked up by the warm air from the furnace be controlled by adjusting or limiting the flow of air through the humidifier.

Commonly the humidifier is connected between the hot air duct and the cold air return of a forced air furnace so that the differential pressure between these ducts causes a flow through the humidifier. The rate at which moisture is picked up when the humidifier is activated is largely dependent on the rate of flow of the air through the humidifier. In turn this flow rate is dependent upon the pressure difference and also on the sizing of the ducting used to connect the humidifier to the furnace plenums.

In practice the ducting is sized for a larger flow than is anticipated and then throttled to limit this flow as required. The amount of throttling will vary with installations and where summertime air conditioning is used the duct may be closed off altogether. Similarly if the furnace is activated simply to circulate unheated air, there need not be any flow through the humidifier.

One approach to controlling the rate of flow has been to place a simple plate between the duct mounting flanges and one of the furnace plenums using one of the sheet metal screws used to attach the duct to the plenum. The plate is then pivoted into position and held there by tightening the screw. While this plate has proven acceptable in the past, it suffers from the disadvantage that the number of screws needed to attach the duct can make it impossible to move the plate into the position needed to close off the duct. Also, the plate is difficult to adjust and has poor aerodynamic characteristics.

It is well established that a better way of controlling flow through a duct is to insert a butterfly valve assembly into a duct. However, in humidifiers such valves tend to be too expensive and bulky. Also many by-pass ducts are of flexible, corrugated material with permanent integral duct flanges, making the splicing of a standard butterfly valve very awkward if not impossible. It is therefore an object of the present invention to provide a butterfly valve which is readily assembled, inexpensive to produce, and which provides manual adjustment without any tooling for use in ducting such as that used with humidifiers.

Accordingly the invention in one of its aspects provides an adjustable damper for positioning in an air duct to adjustably restrict flow of air down the duct. The damper includes a tubular duct section defining first and second diametrically opposed openings and first and second sets of detents formed radially from the material of the duct about the respective openings to define a plurality of damper settings. The first detent set is offset angularly relative to the second detent set and a valve element is provided having a circular central portion proportioned to fit within the duct section. Diametrically opposed first and second shoulders project from the periphery of the disc and aligned first and second stub axles are formed from the material of the disc and depend from the respective first and second shoulders. These shoulders are engaged with the respective first and second sets of detents such that in any one selected angular position of the valve element, the element is located by engagement of one of the shoulders in one of the detents of the detent sets. Means is provided attached to one of the stub axles to permit manual operation to change the angular position of the element in the duct section for positioning one of the shoulders in another of the detents of the detent sets whereby the flow of air through the duct can be controlled in stages by moving the element between fully closed and fully open positions.

This and other aspects of the invention will be better understood in reference to the drawings in which.

Figure 1:
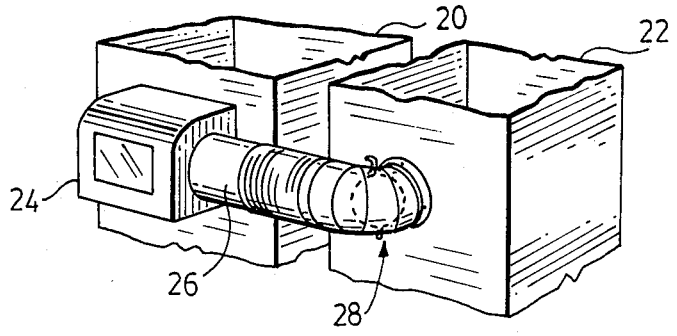
FIG. 1 is a perspective view showing parts of the warm air and return plenums of a forced air furnace and having a humidifier coupled between the plenums using ducting incorporating a preferred embodiment of an adjustable damper according to the invention.

Reference is made first to FIG. 1 which shows a part of a warm air plenum 20 beside a return air plenum 22 of a typical forced air furnace, the rest of which is not shown. A humidifier 24 is attached in conventional fashion to provide moisture to air travelling between the two plenums driven by the pressure differential between the plenums. As previously mentioned, the flow of air through an associated duct 26 is preferably controlled to minimize the possibility of sudden surges of air having high relative humidity which would possibly cause localized condensation around cold parts of houses, particularly windows and exterior surfaces. To control this an adjustable damper 28 is installed in the duct 26 so that the user can throttle the flow of air through this duct to find the best position for the damper in a particular house or other building being heated by the furnace and humidified by the humidifier 24.

Figure 2:
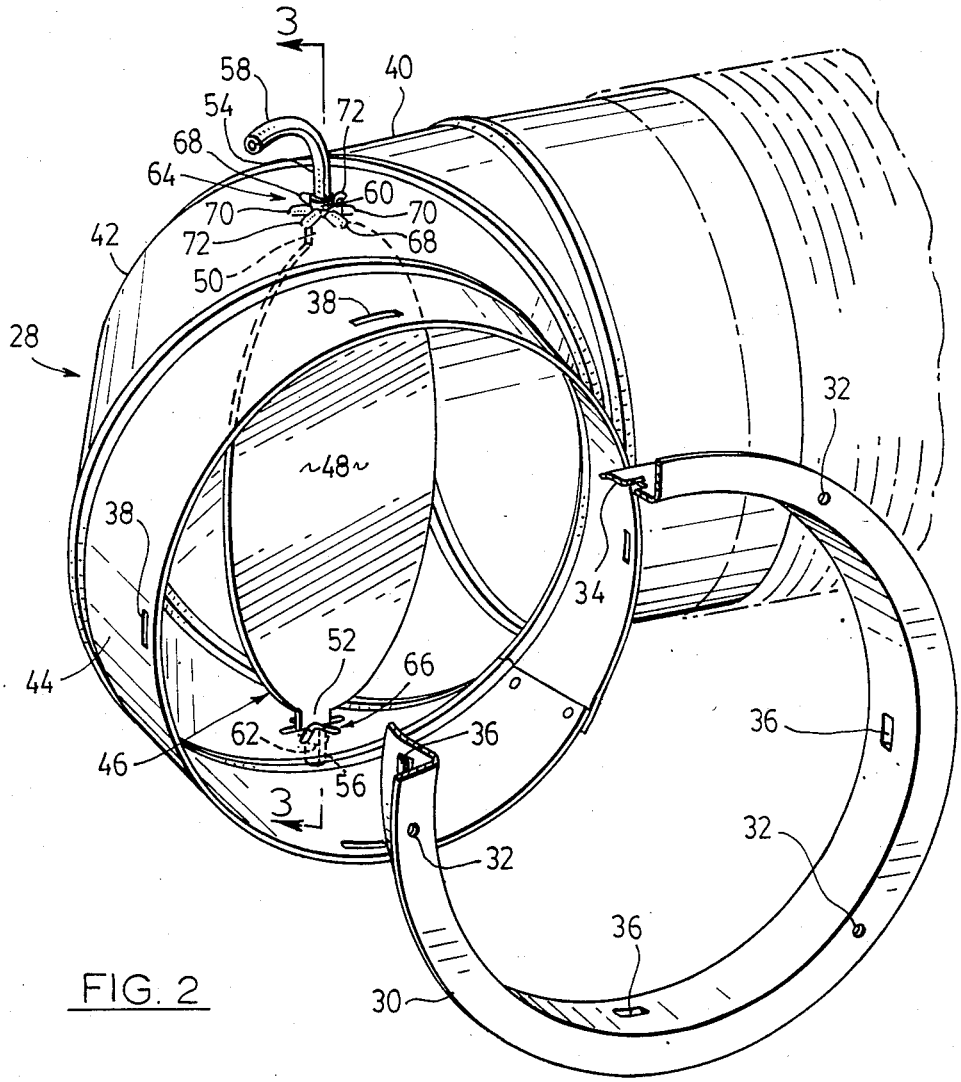
FIG. 2 is a perspective view, partially exploded of the adjustable damper and drawn to a larger scale than that used for FIG. 1.

FIG. 2 is drawn to a larger scale than FIG. 1 and illustrates the adjustable damper in more detail. In this preferred embodiment, the damper takes the form of an elbow which is normally necessary to attach the humidifier 24 in the manner shown in FIG. 1. A mounting ring 30 has openings 32 to receive sheet metal screws for attaching the ring to one of the plenums, in this example the return air plenum 22. A cylindrical portion 34 defines a plurality of outwardly projecting barbs 36 for engagement in slots 38 formed adjacent to the end of the adjustable damper 28. This arrangement permits the damper to be pushed into the ring and be retained there by engagement of the barbs in the slots. The damper 28 consists of a series of duct sections 40, 42, and 44 coupled to one another in conventional fashion to provide an elbow. The central duct section 42 supports a valve element 46 having a central portion 48 in the form of a disc which, when rotated, will fit snugly within the cylindrical internal surface of the element 42. Portion 48 exends into diametrically opposed shoulders 50, 52 from which in turn depend respective stub axles 54, 56. The axle 54 terminates in a curved portion 58 for manual operation of the damper. The axles 54, 56 are journalled in cylindrical tubular portions 60, 62 upset from the material of the section 42 and positioned centrally with respect to detent sets 64, 66.

The axles 54, 56 are formed from the sheet material of the disc and rounded to permit angular movement in the portions 60, 62. Similarly the portion 58 is an extension of the associated axle and formed with a similar cross-section for convenience.

Figure 4:
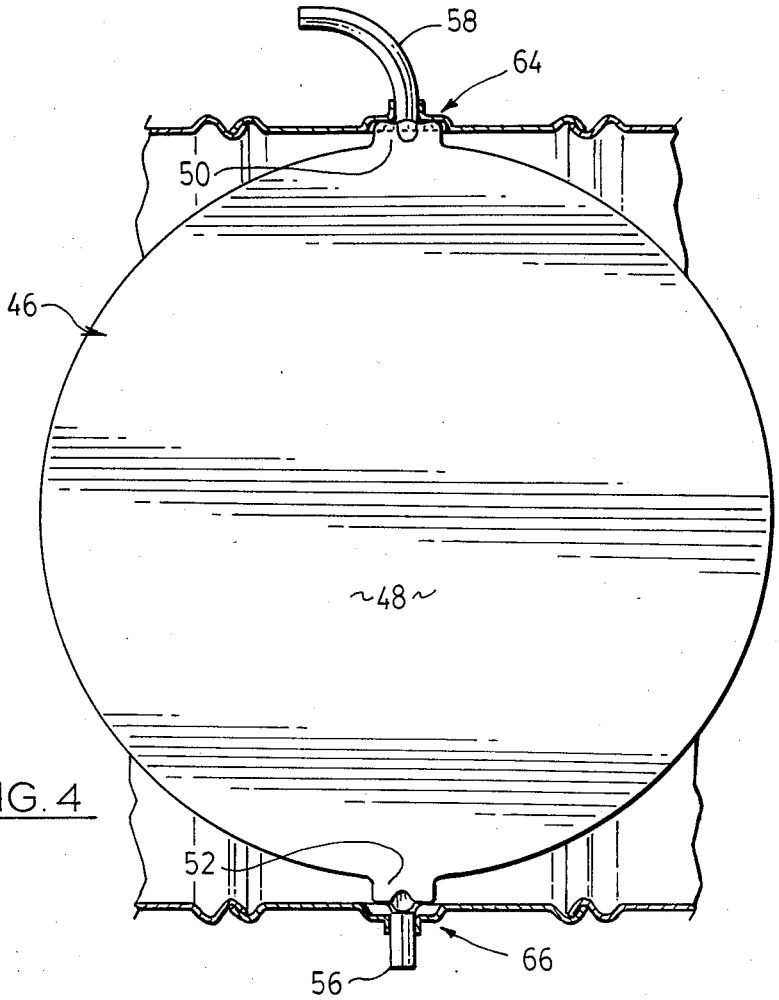
FIG. 4 is a sectional view on line 3—3 and drawn somewhat schematically.
Figure 3:
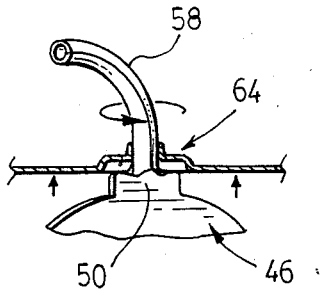
FIG. 3 is a view illustrating movement of the valve element.

The detent set 64 consists of three pairs of recesses 68, 70, 72 extending radially from the cylindrical portion 60 and defining on the inside of the duct section 42 short channels or detents in which the shoulder 50 can locate. As shown in the figure, the shoulder sits in the detents 72 locating the damper in a position partially blocking the ducts but providing for air flow past the damper. FIG. 3 illustrates the curved portion 58 being used to rotate the valve element 46 causing it to jump from one pair of detents into adjacent detents. For instance the element could be set in detents 70 (FIG. 2) to close off the duct and prevent air flow when the furnace is used either in an air conditioning mode or simply circulating air through the building. Detents 68 provide a similar position to the detents 72 and FIG. 4 shows engagement in these detents to also better show the element 46 and its relationship with the detent sets 64, 66.

It will now be evident that the detent set 66 is similar to the set 64 but rotated relative to the axis of rotation containing the element 46 by an amount equal to half of the angular separation between the detents 68, 70 and 72 (as shown this would be 30 degrees). Consequently, when the element 46 is rotated about its axis, it will find positions of location alternately in the set 64 and then in the set 66 so that it can be removed incrementally in the preferred embodiment by amounts of 30 degrees. This is a convenient adjustment which is quite readily done in the form shown. There are limitations in the number of detents which can be created and provide lands between the detents so that there is positive angular adjustment. However, it is evident that different adjustments could be created by using different numbers of detents in each of the detent sets.

The valve element 46 is proportioned so that there is positive bias of one of the shoulders in one of the detent sets held there by slight deformation of the duct section 42. The stress created is insufficient to detract from the duct sections operation as part of an elbow but nevertheless provides positive engagement for the valve element sufficient to retain it in position against the forces created by air flow past it.

The remainder of the duct section 26 is quite conventional and it will be appreciated that in other embodiments it may be preferable to provide the valve element in a different part of the duct, for instance in a cylindrical portion not associated with an elbow. However, as mentioned previously, an elbow is normally used in these assemblies and it is convenient to involve it in the elbow.

These and other embodiments are within the scope of the invention as described and claimed.

We claim:

1. A adjustable damper for positioning in an air duct to adjustably restrict flow of air through the duct, the damper comprising:

a tubular duct section defining first and second diametrically opposed openings;

first and second sets of detents formed from the material of the duct and extending radially about the respective openings to define a plurality of damper settings, the first detent set being offset angularly relative to the second detent set; and a valve element having a circular central portion proportioned to fit within the duct section, diametrically opposed first and second shoulders projecting from the periphery of the disc, aligned first and second stub axles formed from the material of the disc and dependent from the respective first and second shoulders, the shoulders being engageable with the respective first and second sets of detents such that in any one selected angular position of the valve element, the element is located by engagement of one of the shoulders in one of the detents of the detent sets, and means attached to one of the stub axles to permit manual operation to change the angular position of the element in the duct section to position one of the shoulders in another of the detents of the detent sets whereby the flow of air through the duct can be controlled in stages by moving the element angularly between fully closed and fully open positions.

2. An adjustable damper as claimed in claim 1 in which the circular central portion, shoulders, axles, and means providing manual operation are formed integrally from sheet metal.

* * * * *